US006189723B1

(12) United States Patent
Davis et al.

(10) Patent No.: US 6,189,723 B1
(45) Date of Patent: Feb. 20, 2001

(54) COMPOSITE LAMINATED TRANSPORT CONTAINER FOR LIQUIDS

(76) Inventors: Gary R. Davis, 2801 SE. Beacon Hill Dr., West Linn, OR (US) 97068; Kevin D. Davis, 11484 SE. Highland Loop, Clackamas, OR (US) 97015; Carl Christian Lee, 17555 S. Potter Rd., Oregon City, OR (US) 97045

( * ) Notice: Under 35 U.S.C. 154(b), the term of this patent shall be extended for 0 days.

(21) Appl. No.: 09/309,065

(22) Filed: May 10, 1999

(51) Int. Cl.[7] ..... F17C 1/02; F17C 1/06

(52) U.S. Cl. ..... 220/586; 220/562; 220/588; 220/589; 220/590; 220/592; 156/69; 156/184; 156/185; 156/189; 156/191; 156/169; 156/171; 156/172; 428/36.3

(58) Field of Search ..... 156/69, 77, 182, 156/184, 185, 189, 190, 191, 192, 195, 278, 289, 297, 169, 171, 173, 172, 188; 220/562, 567.2, 569, 1.5, 586, 588, 589, 590, 592, 4.12, DIG. 24; 428/36.3, 36.1, 318.4, 319.3

(56) References Cited

U.S. PATENT DOCUMENTS

| | | | | |
|---|---|---|---|---|
| 3,372,075 | * | 3/1968 | Holt et al. | 156/172 |
| 3,669,299 | | 6/1972 | Jones et al. | 220/10 |
| 3,700,527 | * | 10/1972 | Grosh | 156/426 |
| 3,956,816 | | 5/1976 | Short | 29/429 |
| 3,989,562 | * | 11/1976 | Hladik et al. | 156/79 |
| 4,040,163 | | 8/1977 | Tronsberg | 29/423 |
| 4,120,418 | | 10/1978 | Collins et al. | 220/444 |
| 4,222,804 | | 9/1980 | Short | 156/182 |
| 4,640,853 | | 2/1987 | Schmeal et al. | 428/35 |
| 4,930,661 | | 6/1990 | Voorhies | 220/465 |
| 4,963,408 | | 10/1990 | Huegli | 428/71 |
| 5,133,475 | * | 7/1992 | Sharp | 220/589 |
| 5,156,268 | | 10/1992 | Nichols | 206/386 |
| 5,465,865 | | 11/1995 | Coombes | 220/410 |
| 5,763,035 | * | 6/1998 | De La Porte et al. | 428/36.91 |

* cited by examiner

*Primary Examiner*—Michael W. Ball
*Assistant Examiner*—Jessica Rossi
(74) *Attorney, Agent, or Firm*—Klarquist Sparkman Campbell Leigh & Whinston, LLP

(57) ABSTRACT

A composite laminated, generally cylindrical container for over-the-road transportation of liquids by truck is fabricated using a core of cellular thermoplastic expanded foam material, with an encapsulating layer adhered to each of the interior and exterior surfaces. The encapsulating layers of the cylindrical portion each utilize at least one layer of resin-impregnated unidirectional filament material, with the primary filaments extending in the longitudinal direction to provide bending strength, and a plurality of layers of spirally wound, resin-impregnated filaments to resist shear, torsion and external and internal pressure. The core and the encapsulating layers define a bonded sandwich type of construction. The container can be supported only at its forward and rearward ends during over-the-road transportation of liquids, like presently available stainless steel containers.

10 Claims, 6 Drawing Sheets

30
168
164
166
162
178
176
174
170
172
163
28
150
154
32
152
156
160
158
10
26

COMPOSITE LAMINATED TRANSPORT CONTAINER FOR LIQUIDS

FIELD OF THE INVENTION

This invention relates to over-the-road truck transport containers for liquid products and, more particularly, to such containers fabricated from composite materials.

BACKGROUND OF THE INVENTION

Currently in the United States and in other industrialized countries of the world a major fleet structure exists for over-the-road hauling of liquid products, such as gasoline, diesel and aviation fuels, and even more important, for the hauling of liquid food products, such as milk. The majority of this tank trailer fleet is fabricated from stainless steel, which is used for both the internal fluid container and the exterior skin, the containers having an intermediate section comprising a metallic structural framework and insulation.

Welding is the primary process used to fabricate stainless steel tanks and, consequently, 304L or 316L stainless steels are normally used because of their low carbon content. Stainless steel alloys are normally of the 18-8 designation, which indicates that they contain eighteen percent chromium and eight percent nickel. The balance of the usual formulation is iron, with a variety of stabilizing agents, such as molybdenum, titanium and carbon "getter" elements, introduced chemically to bind the carbon into the structure of the stainless steel and prevent it from precipitating out in the grain boundaries during heat treatment or welding.

Chromium is the element that provides stainless steel with its non-corrosive properties. There are only three primary sources of chromium in the world. These are Kazakstan in the former Soviet Union, and Zaire and Zimbabwe in Africa. Kazakstan and Zaire have closed their chromium markets for economic and political reasons. This has resulted in a major chromium shortage. As a result, the price of stainless steel has increased greatly over the past few years.

A stainless steel tank is not only very expensive, it is also very heavy, weighing as much as 9,500 pounds when empty.

There have been a few attempts to use composite materials in the manufacture of over-the-road liquid transport containers, particularly for use in transporting corrosive chemicals and hazardous waste. One such container is the TANKCON™ Fiberglass DOT-412 Transport, sold by Poly-Coat Systems, Inc., Houston, Tex. Unfortunately, ventures into composite materials, such as this, have resulted in containers that weigh as much as their stainless steel counterparts. A TANKCON™ container, for example, having a capacity of 5,400 gallons, weights 13,500 pounds.

The patent literature reflects numerous attempts to use composite structures in the manufacture of food containers. Schmeal et al., U.S. Pat. No. 4,640,853, discloses a carbonated beverage can comprising a thermoplastic core and fiber-adhesive wound layers contiguous to the core. Tronsberg, U.S. Pat. No. 4,040,163, discloses a container made of synthetic resin reinforced by fiber material. Collins et al., U.S. Pat. No. 4,120,418, discloses an insulated container lined with polyurethane foam and wherein a plurality of layers of an epoxy resin formulation and glass-fiber material are applied to the foam.

Other patents disclosing composite containers include Coombes, U.S. Pat. No. 5,465,865; Nichols, U.S. Pat. No. 5,156,268; Voorhies, U.S. Pat. No. 4,930,661; Short, U.S. Pat. No. 4,222,804; Short, U.S. Pat. No. 3,956,816; and Jones et al., U.S. Pat. No. 3,669,299. Huegli, U.S. Pat. No. 4,963,408, discloses a composite laminate comprising a high shear strength, load-bearing matrix disposed between an inner core layer and an outer encapsulating layer. The load-bearing matrix comprises a plurality of layers of load-bearing synthetic filaments. The filaments in each of the layers are arranged in differing angular orientations with respect to the longitudinal axis of the laminate structure.

To the inventors' knowledge, however, no one has heretofore made a generally cylindrical container for over-the-road transportation of liquid food products wherein the container has a cylindrical core, comprising a cellular thermoplastic expanded foam material, encapsulated between layers of resin impregnated materials to form a bonded composite sandwich type construction. The core serves both to provide insulation for the container's contents and to enable the encapsulating layers to provide the necessary structural strength.

It is thus the primary object of the present invention to provide an over-the-road transport container for liquid food products, and wherein the container is made of composite materials and weighs substantially less than comparable stainless steel containers.

It is a further object of the present invention to provide a container as aforesaid that is supportable during transportation only at its forward and rearward ends. The container is thus supported like a stainless steel container during over-the-road transport, being substantially unsupported between its forward and rear ends.

SUMMARY OF THE INVENTION

The invention provides a composite laminated, generally cylindrical container for over-the-road transportation of liquids by truck and comprises a cylindrical portion and a pair of end caps for the cylindrical portion. The cylindrical portion comprises a cylindrical core of cellular thermoplastic expanded foam material and an encapsulating layer adhered to each of the interior and exterior surfaces of the cylindrical core such that the core and the encapsulating layers define a sandwich construction for the cylindrical portion.

Each of the encapsulating layers for the cylindrical portion comprises at least one layer of resin-impregnated, substantially unidirectional filaments. The filaments extend in the longitudinal direction of the cylindrical portion; i.e., parallel to the axis of the cylindrical portion. Each of the layers further comprises a plurality of layers of spiral-wound; i.e., generally circumferentially wound, resin-impregnated filaments adhered to the layer of unidirectional filaments. The unidirectional filaments extending parallel to the axis of the cylindrical portion resist bending, while the spirally wound filaments around the circumference of the container resist shear, torsion and external/internal pressure.

The end caps preferably also comprise a core of cellular thermoplastic expanded foam material and an encapsulating layer adhered to its interior and exterior surfaces. The encapsulating layers for the core, however, comprise a plurality of indexed lengths of resin-impregnated, vinyl ester filaments formed into bands and extending generally radially of the cap. A finite element analysis as prepared by DIAB Technical Center, De Soto, Tex. 75115, has demonstrated adequate factors of safety for both the core and the encapsulating layers.

Means are provided to support the container for over-the-road transportation. They comprise a forward end support for the forward end of the container. The forward end support is adapted to be supported by the fifth wheel of a truck. The means further comprise a rearward end support for the rearward end of the container. The rearward end support is adapted to be supported by a road-contacting trailer, such that the container is substantially unsupported between the forward and rearward end supports like stainless steel containers.

The invention further provides a method of making a composite, laminated, generally cylindrical container for over-the-road transportation of liquids by truck. The container comprises a cylindrical portion and a pair of end caps. The cylindrical portion is of sandwich construction and has an inner core layer and a pair of encapsulating layers. The inner core layer and the outer encapsulating layers are co-adhered to each other.

The method comprises fabricating a cylindrical portion for the container, including providing a collapsible rotatable cylindrical mandrel, and fabricating on the mandrel an inner encapsulating layer for the cylindrical portion. Fabricating the inner encapsulating layer comprises applying at least one layer of vinyl ester resin-impregnated, substantially unidirectional filament material over the cylindrical mandrel, with the substantially unidirectional filaments extending in the longitudinal direction of the cylindrical portion, and spiral winding a plurality of lengths of vinyl ester filaments immersed in liquid vinyl ester resin over the unidirectional filament material and around the cylindrical mandrel.

The method further comprises thermoforming a plurality of expanded plastic foam sheets to form a plurality of pairs of semi-cylindrical sections, with each of the sections having a radius generally equal to the radius of the cylindrical mandrel. The semi-cylindrical sections are placed over the inner encapsulating layer to form a core layer for the cylindrical portion. The semi-cylindrical sections are pressed into the inner encapsulating layer to cause the expanded plastic foam sheets of the semi-cylindrical sections to absorb the vinyl ester resin of the inner encapsulating layer, thereby to become bonded thereto.

The method further comprises fabricating an outer encapsulating layer for the cylindrical portion. Fabricating of the outer encapsulating layer comprises spiral winding a plurality of lengths of vinyl ester filaments immersed in liquid vinyl ester resin around the semi-cylindrical sections of the core. Fabricating further comprises applying at least one layer of vinyl ester resin-impregnated, substantially unidirectional filament material over the semi-cylindrical sections of the core layer.

The method further comprises applying an exterior coating to the outer encapsulating layer, collapsing the cylindrical mandrel, removing the cylindrical portion from the mandrel, and attaching a pair of end caps to the cylindrical portion to complete the container. The end caps are preferably fabricated similarly to the cylindrical portion itself.

DETAILED DESCRIPTION

Figure 3:
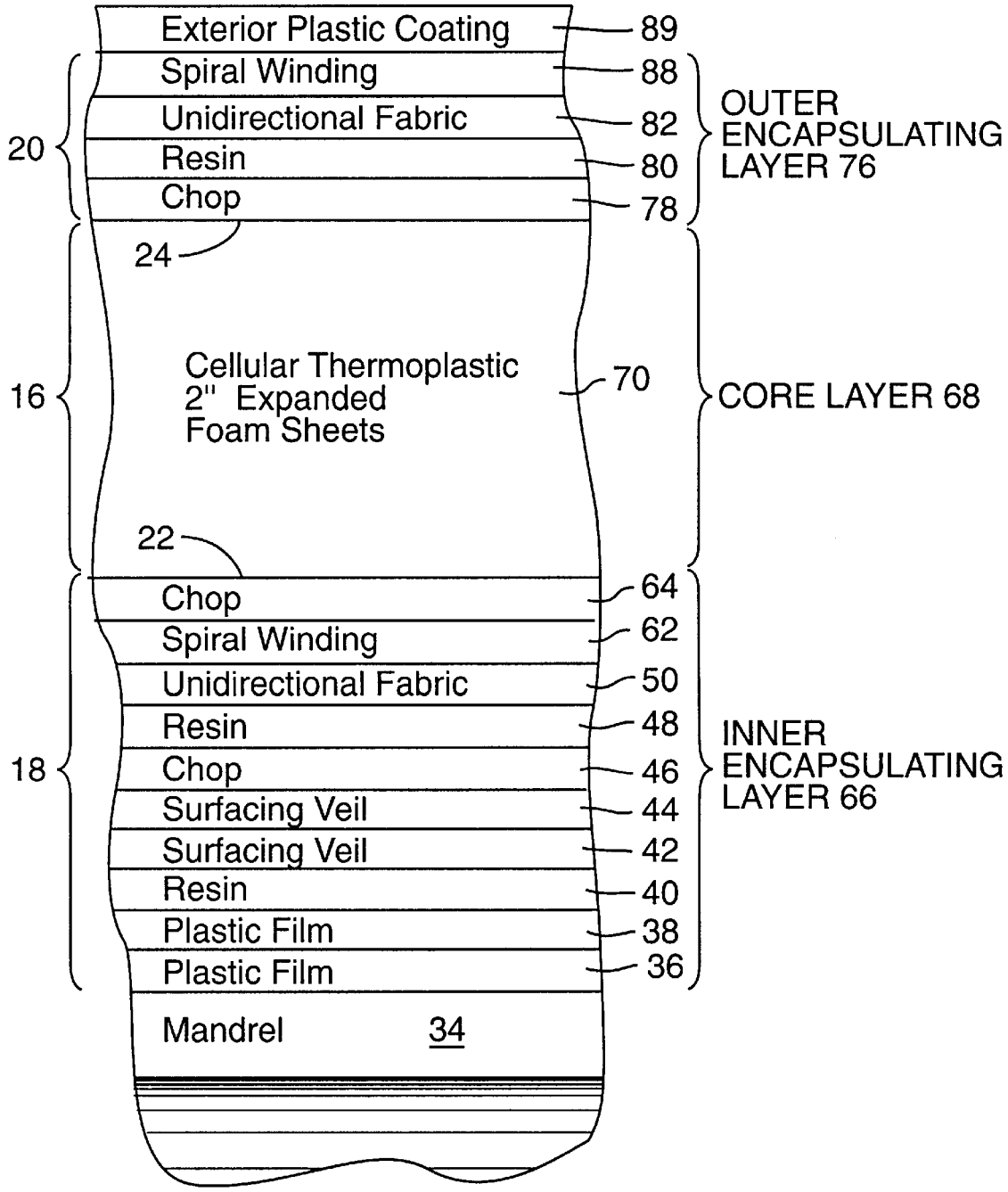
FIG. 3 illustrates schematically the various layers of the cylindrical portion of the container and, thus, a method of laminating it.
Figure 4:
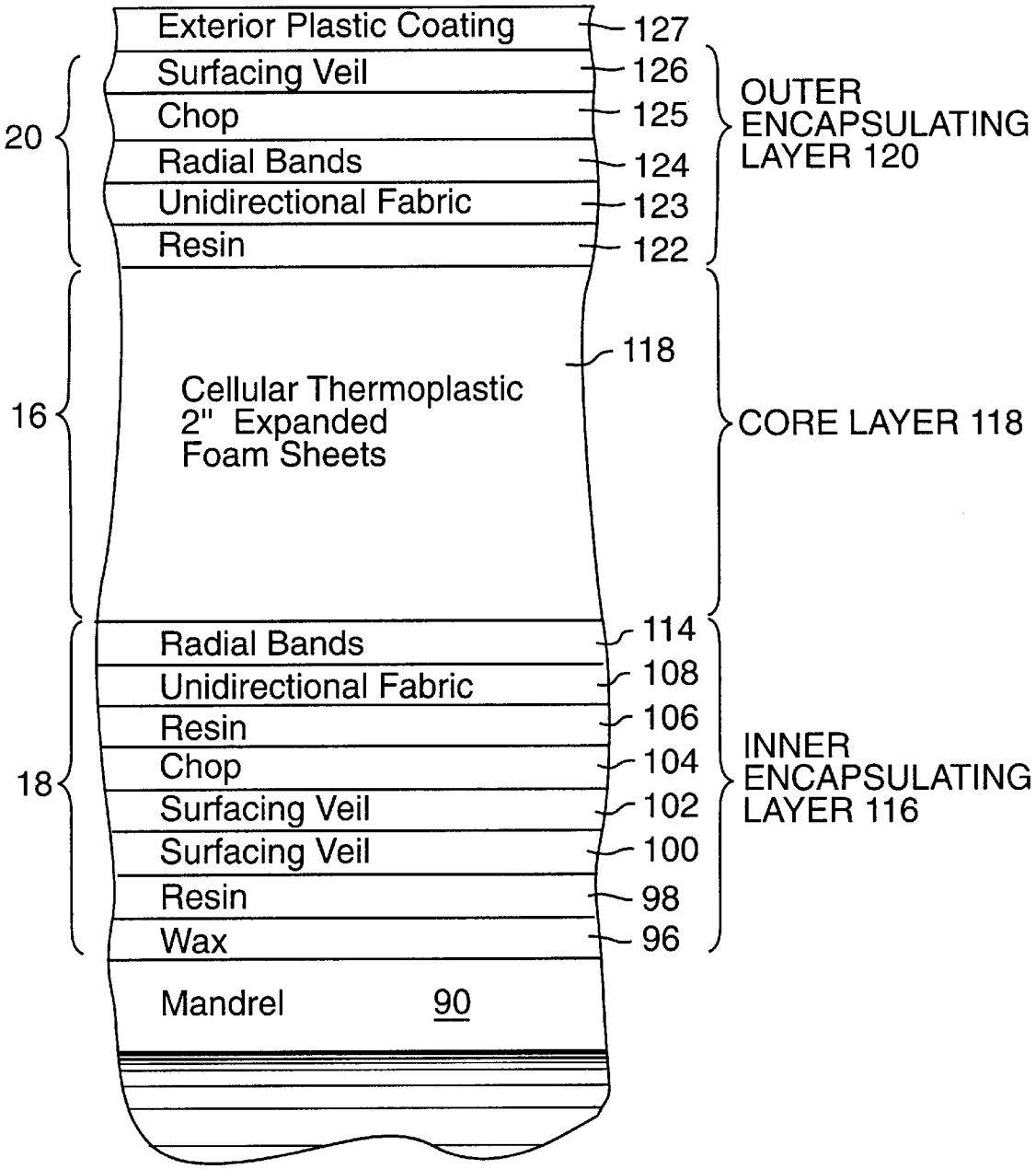
FIG. 4 illustrates schematically the various layers of each of the end caps and, thus, a method of laminating them.

Referring to the drawings, the invention essentially comprises a generally cylindrical container 10 having a cylindrical portion 12 and a pair of generally cup-shaped end caps 14. The cylindrical portion 12 and the end caps 14 are fabricated as a bonded composite laminated sandwich type construction. Each comprises a core 16 (see FIG. 3) of cellular thermoplastic expanded foam material and an encapsulating layer 18, 20 adhered to each of the interior and exterior surfaces 22, 24 thereof such that the core and the encapsulating layers 18, 20 define the sandwich construction. A supporting structure or trailer 26 (see FIG. 9) supports the container 10 adjacent its forward and rearward ends 28, 30, thereby to be able to transport the container 10 over-the-road by a truck 32 as existing stainless steel containers are now transported. Each of these elements will now be described together with its manner of fabrication.

The Cylindrical Portion

Figures 1, 2:
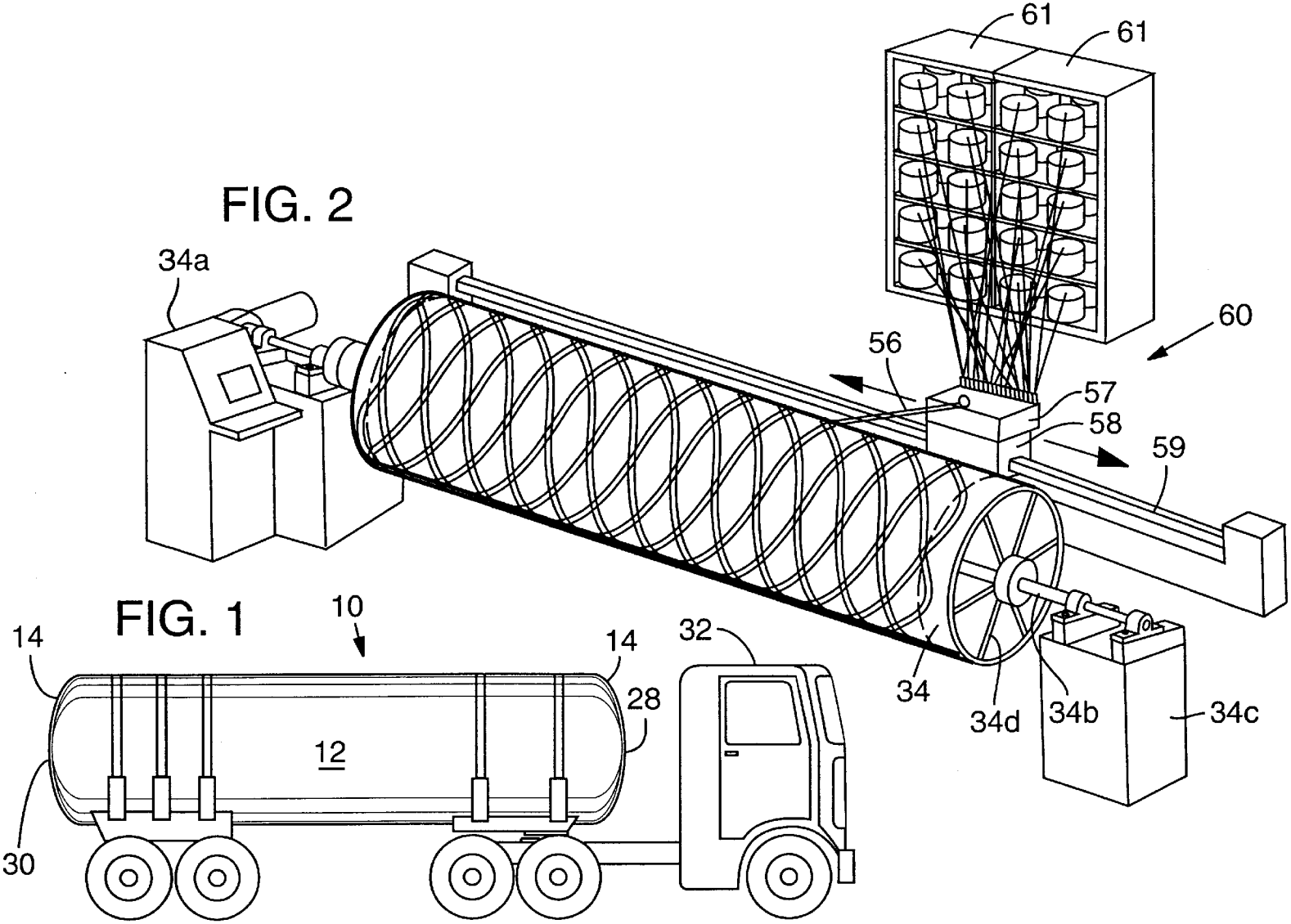
FIG. 1 illustrates the invention mounted on a truck for over-the-road transportation.
FIG. 2 illustrates apparatus for spiral winding resin-impregnated filaments as required to form each of the encapsulating layers.

The cylindrical portion 12 of the container is fabricated on a collapsible rotatable cylindrical mandrel 34 (see FIG. 2), preferably about thirty feet in overall length and having an outside diameter of about 68.4 inches such that the container 10 itself has an internal volume of five thousand gallons. The mandrel 34 may be made sixty feet long if desired to fabricate a sixty-foot-long section, such that after fabrication it can be cut in two to provide, in a more cost efficient manner, two cylindrical portions 12 each thirty feet long. A mandrel 34 suitable for the purpose is a Dura Wound® tank mandrel, specifically designed for filament winding fiberglass tanks, and obtainable in various sizes from Dura-Wound Inc., Washougal, Wash. 98671. Such tank mandrels are made of steel or aluminum, are generally computer controlled as by a computer console 34*a,* have a steel shaft 34*b* journaled in a support 34*c,* and are provided with internal bracing 34*d.* The mandrels are generally hinged on one side and collapsible. Screw jacks disposed internally (not shown) are coupled together to collapse the mandrel 34 on one side. The screw jacks can be operated either by hand or they can be hydraulic.

The mandrel 34 is first spiral wrapped with a strip of twelve-inch wide, two-mil thick, E. I. du Pont de Nemours and Company, black Mylar® flexible synthetic plastic film, fifty percent overlapped, to form a first layer 36 of a releasing material. See FIG. 3. (All wrapping and spraying operations are carried out while the mandrel 34 is being rotated.) The layer 36 is then spiral wrapped in the opposite direction with a second strip of twelve-inch wide, two-mil thick, E. I. du Pont de Nemours and Company, clear Mylar® film, fifty percent overlapped, to form a second layer 38 of releasing material. The layers 36, 38 facilitate the ultimate release of the cylindrical portion 12 from the mandrel 34.

A heavy layer 40 of vinyl ester resin is then sprayed over the layer 38 while the mandrel 34 is rotating. A resin suitable for the purpose is Derakane® 411-350PA, manufactured by The Dow Chemical Company, Plastics Group, Midland, Mich. 48674. This resin has a viscosity of 350 cps at 77° F. and a specific gravity of 1.045. To the inventors' knowledge, this is the first time a vinyl ester resin has been used to fabricate a transport container for liquid food products.

A strip of surfacing veil is then wound around the mandrel 34, with fifty percent overlap, to form a layer 42. A material suitable for this purpose is a Viledon® glass surfacing veil, T1785 E Glass, manufactured by Freudenberg Nonwovens Limited Partnership, Chelmsford, Mass. 01824. This material has a weight of 14 g/m$^2$, a thickness of 0.15 mm, and a resin absorption of 160 g/m$^2$.

A further layer 44 of an apertured polyester surfacing veil, for example, Nexus® apertured polyester surfacing veil, Style 111-010, manufactured by Precision Fabrics Group Inc., Formed Fabrics Division, Greensboro, N.C. 27401, is then wound around the layer 42 with an overlap of two inches. This material has a weight of 31–34 g/m$^2$, a thickness of 0.21–0.33 mm, and is suitable for subsequent filament winding.

A layer 46 of "chop", preferably five mils thick, is applied to the layer 44 as the mandrel 34 is rotated. "Chop" is the colloquial term used for a mixture of liquid vinyl ester resin and chopped vinyl ester filament typically applied prior to spiral filament winding. A suitable resin is also Derakane® 411-350PA. A suitable filament is a Vetrotex Certain Teed isophthalic polyester resin roving R099®-625 manufactured by Vetrotex Certain Teed Corporation, Valley Forge, Pa. 19482. This material has a glass content by weight of between about 69.0 and 73.5 percent, a horizontal shear strength (dry) of between about 6460 and 7830 psi, and a horizontal shear strength (wet) of between about 4060 and 4930 psi. The filament is preferably cut ("chopped") into lengths of one inch, mixed with the liquid vinyl ester resin and applied using a "chop" gun. A suitable apparatus for this purpose is Glass Craft Model No. 18913-00, manufactured by Glass Craft, Inc., Indianapolis, Ind.

Another heavy layer 48 of Derakane® 411-350PA resin is then applied over the layer 46. A layer 50 of weft unidirectional fabric is applied over the layer 48 to provide the cylindrical portion 12 of the container 10 with sufficient axial bending strength. A suitable fabric for this purpose is Knytex™ E-Glass weft unidirectional fabric, Style D155, obtainable from CMI/Composite Materials Inc., Arlington, Wash. 98223. This fabric has a weight of 15.5 oz/yd$^2$ and a thickness of 0.021 inch. The fabric is preferably applied with a fifty percent overlap as the mandrel 34 is being rotated.

A plurality of isophthalic polyester resin filaments, again preferably the same filaments used to make the layer 46 (for example, Vetrotex Certain Teed R099®-625 filaments) are formed into a band 56 four inches wide. See FIG. 2. The band 56 is passed through a tank 57 of liquid vinyl ester resin, again preferably Derakane® 411-350PA resin, to form a vinyl ester resin immersed filament band. A machine 60 (apparatus, for example, manufactured by Addax, Inc., Lincoln, Nebr. 68521 and computer controlled for filament winding) is used for this purpose. The apparatus has twenty spools on each of two stands 61 with a carriage 58 reciprocating on a rail 59. It is used to wind the resin immersed filament band 56, back and forth, spirally around and over the unidirectional fabric layer 54 at an angle of 80° from the horizontal, to achieve a 0.040-inch thick spirally wound layer 62. The layer 62 of spirally wound filament bands 56 resists shear and torsion, also external and internal pressure on the container.

A layer 64 of chop, preferably ten mils thick, is then applied to the spirally wound layer 62. The layer 64 is applied in a manner similar to that used to apply the previous layer 46.

The layers 36, 38, 40, 42, 44, 46, 48, 50, 62 and 64 form an inner encapsulating layer 66 about 3/16-inch thick.

An inner core layer 68 is then constructed comprising a plurality of thermoformed semi-cylindrical, cellular thermoplastic expanded foam sheets 70. A material suitable for the purpose is two-inch-thick Divinycell® H grade core material, either H 100, having a density of 100 kg/m$^3$ (6 lbs/ft$^3$), or H 60, having a density of 60 kg/M$^3$ (4 lbs/ft$^3$). A preferred source for the material is Divinycell International, Inc., DeSoto, Tex. 75115. It is a partially cross-linked, structural cellular core material, expanded according to a chlorofluoro carbon free process to form a rigid core material. Use of Divinycell® H 60 instead of H 100 for the core reduces the overall weight of the container and results in an increased R-value, i.e., better insulation.

Individual sheets sized approximately four feet by nine feet are thermoformed into the semi-cylindrical sheets 70 by heating them to the softening point and forcing them against the contour of a mold having a radius generally equal to the external radius of the mandrel 34. A sheet nine feet long provides the core material required for one-half of the cylindrical portion 12. Many different methods may be used to thermoform a sheet into a semi-cylindrical shape. These methods include vacuum assisted forming, use of pressure, and other known methods.

Semi-cylindrical sheets 70 are perforated and then placed over the inner encapsulating layer 66, staggered longitudinally, and then seamed top and bottom to form the core layer 68. A series of polyvinyl ester filament straps (not shown) are then wrapped around the semi-cylindrical sheets 70, preferably on two foot centers, and tightened to cause the perforated foam material of the sheets 70 to absorb the liquid vinyl ester resin of the encapsulating layer 66. This causes the encapsulating layer 66 to become firmly bonded to the core layer 68, ultimately to form an integral sandwich type structure. The inner and outer encapsulating layers 66, 76 resist the majority of the applied loads and the core layer 68 serves primarily to stabilize the encapsulating layers and, of course, also provide thermal insulation.

The outer encapsulating layer 76 is then fabricated in a manner similar to the inner layer 66. A layer 78 of "chop", preferably, five mils thick, is first applied to the core layer 68 in a manner similar to that used to apply the layer 46. A heavy layer 80 of Derakane® 411-350PA resin is applied over the layer 78. A layer 82 of fifty percent overlapped Knytex Style D155 weft unidirectional fabric (the same as layer 50) is applied over the layer 80. A 0.040-inch thick, 80° spirally wound filament band layer 88 is applied over the weft unidirectional fabric layer 82 to complete the outer encapsulating layer 76. Finally, an exterior plastic coating 89, for example, White Base 766W14100, a polyester gel coat, manufactured by Lilly Industries, Inc., Gardena, Calif. 90248, is applied to the layer 88 to complete the cylindrical portion 12.

The layers 78, 80, 82, and 88 form an outer encapsulating layer 76 about 3/16-inch thick. The liquid vinyl ester resin of the layer 76 is absorbed into the plastic foam sheets 70 of the core layer 68 in a manner similar to the absorption achieved between the inner encapsulating layer 66 and the core layer 68. This causes the inner and outer encapsulating layers 66, 76, together with the core layer 68, all to become firmly bonded together to form the complete integral sandwich type structure of the invention.

It is possible to achieve a lighter weight container 10, if desired. The thickness of each of the inner and outer encapsulating layers 66, 76 may be reduced from 3/16inch to 1/8 inch by reducing the thickness of the "chop" and spirally wound layers. Also, the core density may be reduced from 6 lbs/ft$^3$ to 4 lbs/ft$^3$ by using, for example, Divinycell® H 60 instead of Divinycell® H-100. A container, including end caps, thirty feet long and having 3/16-inch thick encapsulating layers and a two-inch Divinycell® H 100 core layer, weighs approximately 1,740 pounds. A similar length container, including end caps, made with 1/8-inch thick encapsulating layers and a two-inch thick H 60 core, weighs approximately 1160 pounds.

The End Caps

The end caps 14 are fabricated similarly to the fabrication of the cylindrical portion 12, except that they are fabricated on a generally cup-shaped form or mandrel 90 (see FIG. 6A) instead of on a cylindrical mandrel 34. The form 90 is made in the desired shape of an end cap 14 and is mounted on a rotatable support 91. The form 90 has a curved section 92 and a generally cylindrical section 94 adapted to facilitate the attachment of the end caps 14 to the ends of the cylindrical portion 12. A preferred procedure for effecting the attachment will be described hereinafter.

A layer of wax 96 is first applied to the exterior surface of the form or mandrel 90 to facilitate the ultimate release of the end cap 14 from the form 90. A suitable product is a mold release, part No. 1000L (liquid) or 1000P (paste), manufactured by Finish Kare, 1750 Floradale Avenue, South El Monte, Calif. 91733. A heavy layer 98 of vinyl ester resin, again, for example, Dow Derakane® 411-350PA, is sprayed over the layer 96. A layer 100 of surfacing veil, with fifty percent overlap, is then applied over the layer 98. Again, a preferred material is Viledon® glass surfacing veil, T1785 E Glass. Another layer 102 of surfacing veil, again, for example, Nexus® apertured polyester surfacing veil, Style 111-010, is applied with a two-inch overlap over the first surfacing veil layer 100.

A layer 104 of "chop", preferably five mils thick, is applied to the layer 102 in a manner similar to the application of the layer 46 to the cylindrical portion 12. Again, a suitable resin is Derakane® 411-350PA, and a suitable filament, cut ("chopped") into one-inch lengths, is Vetrotex Certain Teed R099®-625.

A layer 106 of Derakane® 411-350PA resin is applied over the chop layer 104.

A layer 108 of warp unidirectional fabric, with fifty percent overlap, is wound around the cylindrical portion 94 with its warp fibers running around the circumference. Its purpose is to maintain fiber integrity within the cylindrical portion 94*a* of the end cap 14 (the portion fabricated on the cylindrical section 94 of the form 90—see FIG. 6A.) A suitable fabric is a warp unidirectional fabric obtainable from CMI/Composite Materials Inc., Arlington, Wash. 98223, under the product name "Hot Melt Unidirectional", Product Code 1310.5. This fabric has a weight of 12.6 oz/yd$^2$ and a warp/weft strength ratio of 99.15:0.85.

Figures 5A, 5B, 5C, 5D, 5E, 6A, 6B, 6C, 6D, 6E, 7A, 7B, 7C:
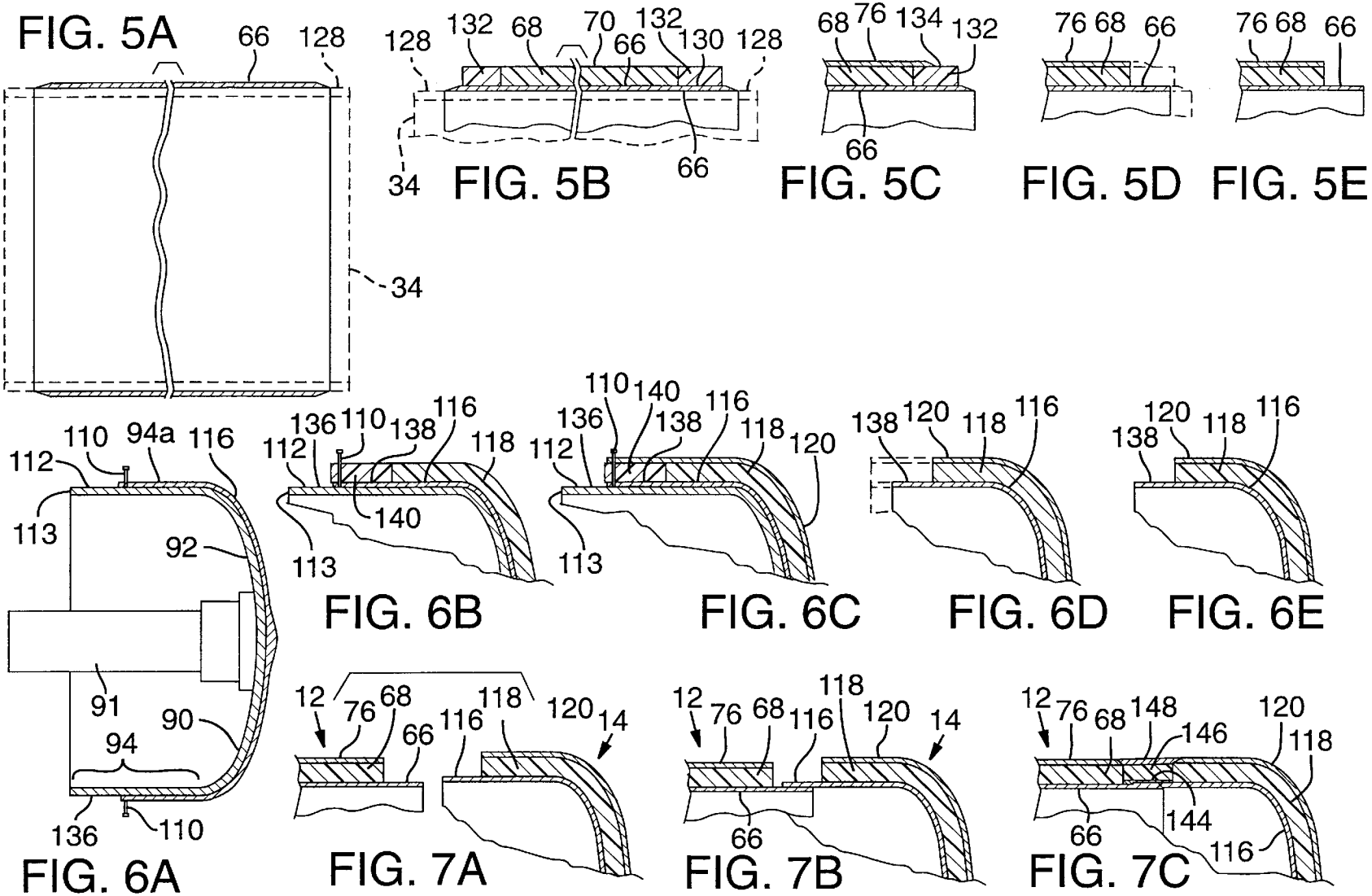
FIG. 5A illustrates the cylindrical portion of the container after the inner encapsulating layer has been formed on the mandrel.
FIG. 5B illustrates a part of the cylindrical portion of the container shown in FIG. 5A after the expanded plastic foam core has been bonded to the inner encapsulating layer.
FIG. 5C illustrates the part of the cylindrical portion of the container shown in FIG. 5B after the outer encapsulating layer has been formed on and bonded to the expanded plastic foam core.
FIG. 5D illustrates the part of the cylindrical portion of the container shown in FIG. 5C after an end has been prepared for joining to an end cap.
FIG. 5E illustrates the part of the cylindrical portion of the container shown in FIG. 5D ready for joining to the end cap.
FIG. 6A illustrates an end cap being formed on a rotatable end cap form or mandrel after an inner encapsulating layer has been fabricated on the form.
FIG. 6B illustrates a part of the end cap shown in FIG. 6A after an expanded plastic foam core has been bonded to the inner encapsulating layer.
FIG. 6C illustrates the part of the end cap shown in FIG. 6B after an outer encapsulating layer has been formed on and bonded to the expanded plastic foam core.
FIG. 6D illustrates the part of the end cap shown in FIG. 6C showing an inner end prepared for joining to the end of the cylindrical portion shown in FIG. 5D.
FIG. 6E illustrates the part of the end cap shown in FIG. 6D ready for joining to the end of the cylindrical portion shown in FIG. 5D.
FIG. 7A illustrates the part of the cylindrical portion of the container shown in FIG. 5E in position to be joined to the part of the end cap shown in FIG. 6E.
FIG. 7B illustrates the parts shown in FIG. 7A after they are joined together.
FIG. 7C illustrates the parts shown in FIG. 7B after a transition portion has been fabricated to join the cylindrical portion to the end cap.

The encapsulating layers of the end caps 14 are primarily reinforced using a plurality of lengths of vinyl resin immersed filament bands two inches wide instead of the spiral winding used on the cylindrical portion 12. The bands are applied generally radially across the convex curved outer surface 92 of the form 90 over the unidirectional fabric layer 108. To accomplish this, the form 90 is provided with a plurality of radially extending pins 110 spaced circumferentially 1½ inches apart around the exterior portion 112 of the form 90, as shown in FIGS. 6A, 6B and 6C. As a band is applied radially across the face of the curved section 92, it is looped around a pin 110. The form 90 is rotated on its support 91 a selected number of degrees, for example, 3.6 degrees, such that the radially extending bands are indexed the selected number of degrees in the circumferential direction. In this manner the entire convex surface 92 of the form 90 is covered to form a layer 114 of radially extending bands. The layers 96, 98, 100, 102, 104, 106, 108 and 114 comprise the inner encapsulating layer 11 6 for the end cap 14.

A core layer 118 for the end cap 14 is then applied. Thermoplastic expanded foam material, preferably two-inch thick Divinycell® H 100 or H 80, the latter having a density of 80 kg/m$^3$ (5 lbs/ft$^3$), is thermoformed into a shape compatible to the form 90 and placed over the inner encapsulating layer 116. (Divinycell® H 80 is used for the end caps 14 in container fabrications where H 60 is used in the cylindrical portion to achieve an adequate factor of safety for the end caps 14. End caps are subject to inertia forces, i.e., so called "slamming" pressure, due to surges in tank contents and thus, require additional reinforcement over that required by the cylindrical portion itself.) The thermoplastic expanded foam material of the core layer 118 is perforated and then pressed into the inner encapsulating layer 116, as in the case of the cylindrical portion 12, to cause the expanded foam to absorb the liquid vinyl ester resin of the inner layer 116. This bonds the layers together and, ultimately, forms the desired integral sandwich type structure.

An outer encapsulating layer 120 is then fabricated. A layer 122 of Derakane® 411-350PA resin is first applied over the thermoplastic foam core 118. A layer 123 of warp unidirectional fabric with fifty percent overlap, similar to the layer 108, is applied over the layer 122. A layer 124 of radially indexed, two-inch wide lengths of resin immersed filament bands is applied over the layer 123 in a manner similar to that used to fabricate the layer 114. A layer 125 of "chop", similar to the layer 104, is applied over the layer 124. A layer 126 of surfacing veil, similar to the layer 100, is applied over the layer 125. Finally, an exterior plastic coating 127, a polyester gel coat similar to the layer 89, is applied to the layer 126 to complete the end cap 14.

The layers 122, 123, 124, 125 and 126 form the outer encapsulating layer 120. The liquid vinyl ester resin of the outer encapsulating layer 120 is absorbed into the thermoplastic foam of the core 118 in a manner similar to the absorption achieved between the inner encapsulating layer 116 and the core 118. This causes the inner and outer encapsulating layers 116, 120, together with the core 118, all to become firmly bonded together to form the desired complete integral sandwich type structure.

Joining Cylindrical Portion and End Caps

A method of fabricating and joining the end caps 14 to the cylindrical portion 12 is illustrated schematically in FIGS. 5A–E, 6A–E and 7A–C. As shown in FIG. 5A, the inner encapsulating layer 66 is applied to the mandrel 34 in a manner so as to leave a portion 128 of the mandrel 34 exposed for run-out. As shown in FIG. 5B, the thermoplastic sheets 70 of the core layer 68 are then applied over the layer 66 to leave exposed a portion 130. A circular layer of foam plastic 132; e.g., Dow Chemical Company Styrofoam® plastic, is applied over the exposed portion 130 of the layer 66 effectively to create a "spacer" for run-out of layer 76.

As shown in FIG. 5C, the outer encapsulating layer 76 is applied over the core layer 68 and part of the foam plastic layer 132 to leave a portion 134 of the foam plastic layer 132 exposed for run-out. As shown in FIG. 5D, the portion of the outer encapsulating layer 76 extending over the foam plastic layer 132, together with the foam plastic layer 132 itself, are then cut away to leave each end of the cylindrical portion 12 in the manner shown in FIG. 5E. See also FIG. 8 where the various layers are schematically illustrated to a larger scale.

As shown in FIG. 6A, the inner encapsulating layer 116 of an end cap 14 is applied over the cup shaped form or mandrel 90 to leave a portion 136 of the exterior of form 90 exposed. As shown in FIG. 6B, the thermoplastic core 118 is applied over the layer 116 to leave a portion 138 of the inner encapsulating layer 116 exposed. A cylindrical layer of foam plastic 140, e.g., again Dow Styrofoam® plastic, is applied over the exposed portion 138 of the inner encapsulating layer 116 to create another "spacer".

As shown in FIG. 6C, the outer encapsulating layer 120 is applied over the core layer 118 and the foam plastic layer 140. As shown in FIG. 6D, the portion of the outer encapsulating layer 120 extending over the foam plastic layer 140, together with the foam plastic layer 140 itself, are cut away to leave the inward end of the cap 14 in the manner shown in FIG. 6E.

The cylindrical portion 12 is removed from the mandrel 34 by collapsing the mandrel and sliding the portion off. The end cap 14 is brought into juxtaposition with the cylindrical portion 12, as shown in FIG. 7A. The cylindrical portion 12 and the end cap 14 are brought together with the inner encapsulating portion 116 of the end cap 14 overlapping the inner encapsulating portion 66 of the cylindrical portion 12 to form a transition attachment region, as shown in FIGS. 7B and enlarged in FIG. 8.

Figure 8:
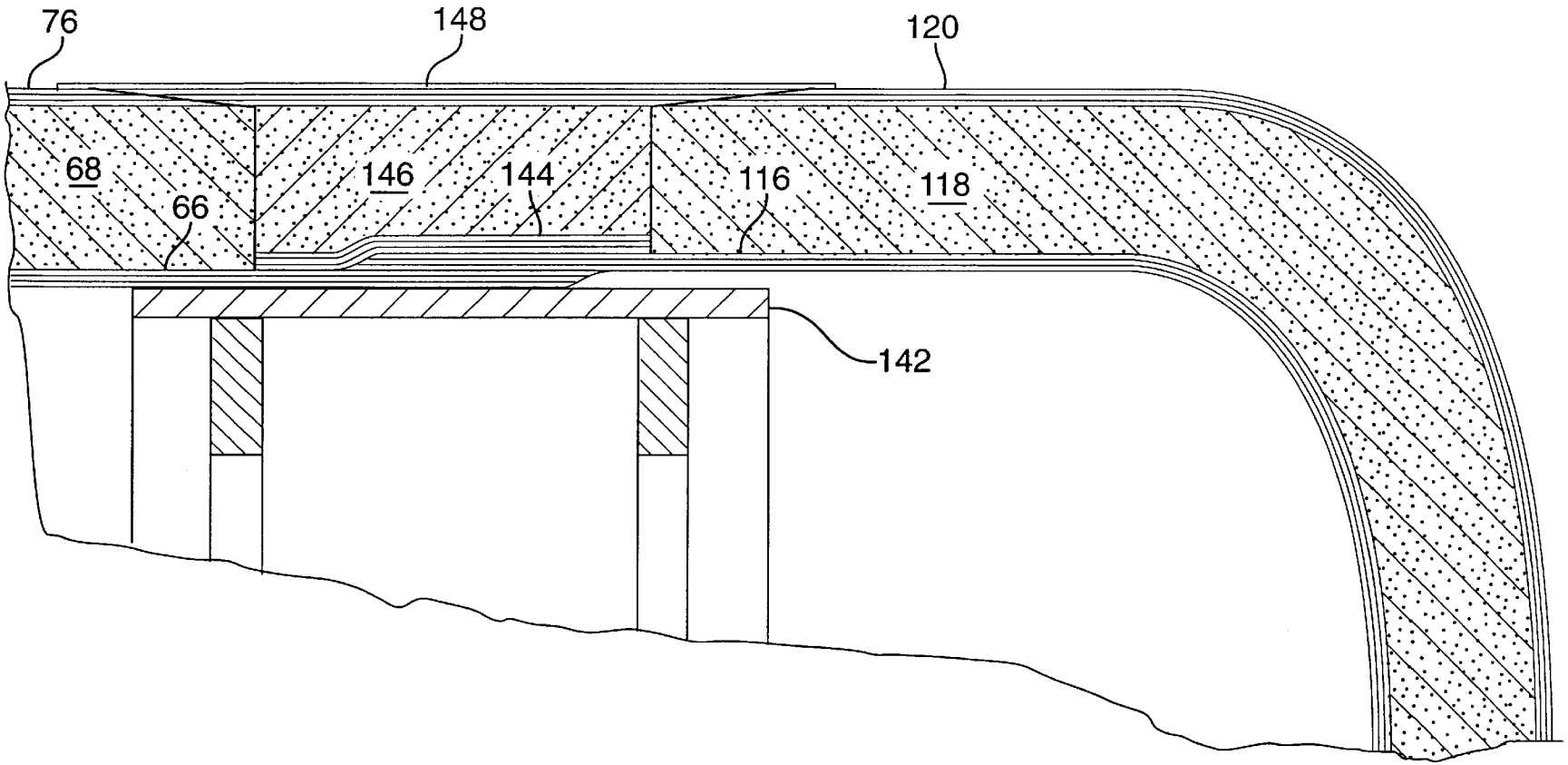
FIG. 8 illustrates schematically, and to a larger scale, the parts shown in FIG. 7C illustrating the details of the transition portion.

A collapsible, circumferentially extending support jig 142 (see FIG. 8) is positioned under the layers 66 and 116. A circumferentially extending patch 144, fabricated similarly to the inner encapsulating layer 66, is applied over the overlapping inner encapsulating portions 66 and 116. Since the thicknesses of the inner encapsulating layers 66 and 116 are only about ⅛- to 3/16-inch thick, the schematic representation shown in FIG. 8 is considerably exaggerated and, in reality, the actual transition is relatively smooth.

A pair of semi-cylindrical thermoplastic foam sheets 146 are placed over the patch 144 to create a core for the transition region. The sheets 146 are pressed into the patch material to cause the expanded foam material of the sheets 146 to absorb the liquid vinyl ester resin of the patch 144. Finally, an outer encapsulating patch 148, fabricated similarly to the outer encapsulating layer 76, is applied over the foam sheets 146 of the transition core. The liquid vinyl ester resin of the patch 148 is absorbed into the plastic foam sheets 146. This causes the inner and outer patches 144, 148, together with the foam sheets 146 of the transition core, all to become firmly bonded together to complete the joining of the end cap 14 to the cylindrical portion 12. See also FIG. 7C.

Container Support

As stated hereinabove, the container 10 of the invention needs only to be supported at its forward and rearward ends 28, 30 in a manner similar to that used to support standard stainless steel tank trailers.

Figures 9, 10:
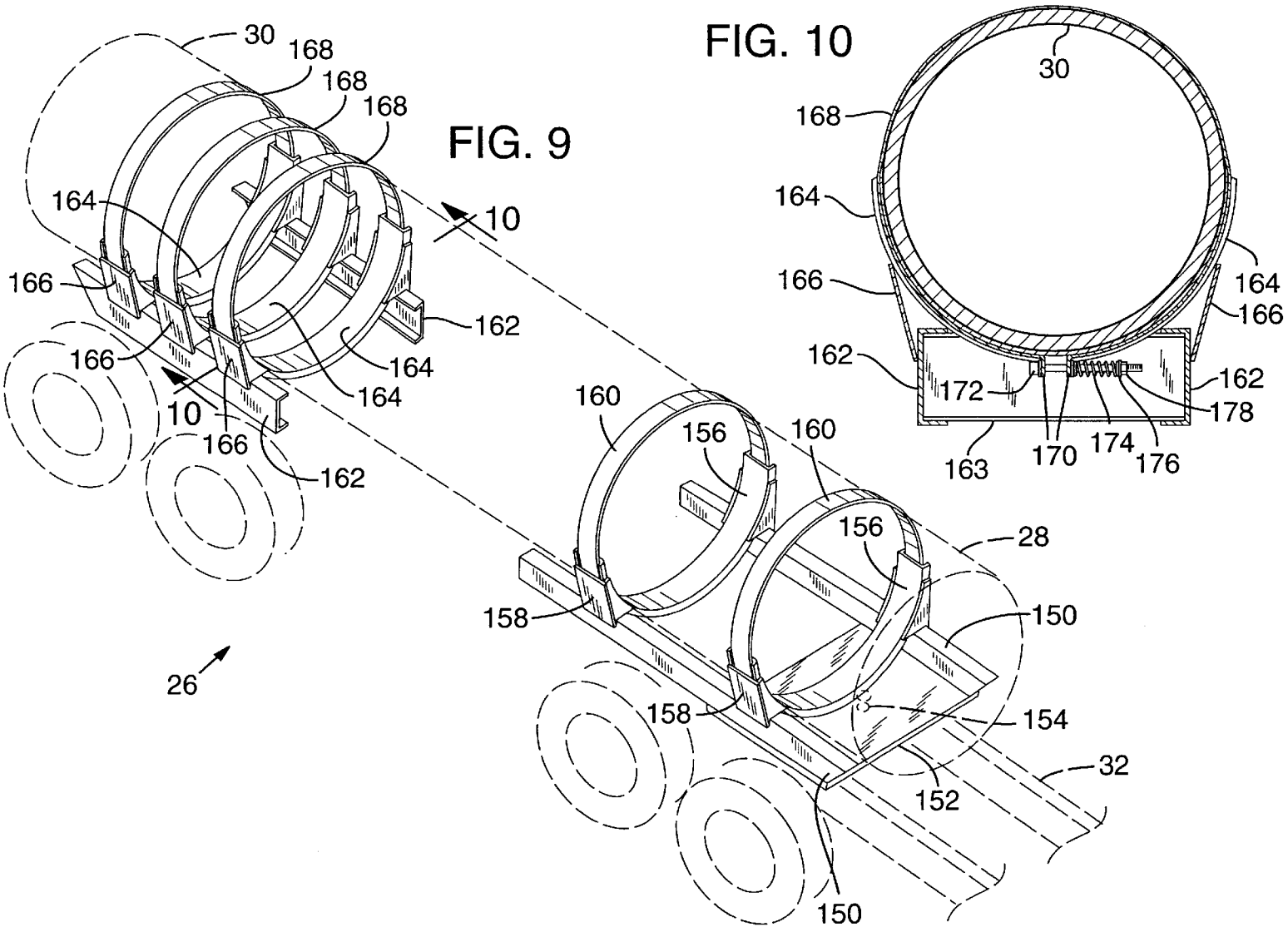
FIG. 9 illustrates a preferred supporting structure for the container of the invention.
FIG. 10 is a sectional view taken on line 10—10 of FIG. 9.

As shown in FIG. 9, a pair of channel beams 150, preferably made of aluminum, provide support for the forward end 28 of the container 10. The beams 150 are supported by a steel platform 152 rotatably supported by the fifth wheel 154 of the truck 32. A pair of semi-circular support channels 156 (having flanges extending generally outwardly) are received in and welded to generally channel-shaped gusset structures 158 (having flanges extending generally inwardly) welded to the box beams 150. The forward end 28 of the container 10 is retained by a pair of steel straps 160, each of which is received in the space defined by the flanges of a respective support channel 156 and its respective gusset structure 158.

The rearward end 30 of the container 10 is supported by a pair of aluminum channels 162 joined by cross members 163 to form the rear truck trailer carriage. See FIGS. 9 and 10. Three support channels 164 (having flanges extending generally outwardly) are received in and welded to generally channel-shaped gusset structures 166 (having flanges extending generally inwardly) welded to the channels 162. The rearward end 30 of the container 10 is retained by three steel straps 168, each of which is received in the space defined by the flanges of a respective support channel 164 and its respective gusset structure 166.

As shown in FIG. 10, the ends 170 of the straps 160 and 168 are bent downwardly and provided with apertures (not shown) to receive a retaining bolt 172 provided with a tension-adjusting spring 174, a washer 176 and nut 178. The spring 174 is selected to limit the tension on the straps 160 and 168 to a desired amount, thereby to provide a yielding but adequate retention for the container 10.

We have thus provided a generally cylindrical container for over-the-road transportation of liquid materials wherein a core material comprising cellular thermoplastic expanded foam material is encapsulated between and bonded to inner and outer layers of resin impregnated materials to form a composite sandwich type construction. The foam core serves both to provide thermal insulation and to stabilize the encapsulating layers to allow them to furnish the required bending, torsional and internal/external pressure resisting strength. The resulting structure weighs significantly less than presently available tank trailer structures, thereby to result in a container that has greatly increased payload capacity and greatly reduced travel costs.

Although the invention has been illustrated and described with reference to a specific example, it is to be understood that it is intended to cover all modifications and equivalents coming within the scope of the following claims.

What is claimed is:

1. In combination, a composite laminated generally cylindrical container for over-the-road transportation of liquids by truck, the container comprising:

a cylindrical portion, the cylindrical portion comprising:

a cylindrical core comprising cellular thermoplastic expanded foam material, and an encapsulating layer adhered to each of the interior and exterior surfaces of the cylindrical core, the cylindrical core and the encapsulating layers defining a bonded sandwich construction for the cylindrical portion, the encapsulating layers each comprising:

at least one layer comprising resin-impregnated, substantially unidirectional filaments, the filaments extending in the longitudinal direction of the cylindrical portion, and a plurality of layers of spirally wound, resin-impregnated filaments adhered to the layer of unidirectional filaments; and a pair of end caps for the cylindrical portion, at least one of the end caps comprising:

a core comprising cellular thermoplastic expanded foam material, and an encapsulating layer adhered to each of the interior and exterior surfaces of the core, the encapsulating layers comprising at least one layer of resin-impregnated warp unidirectional filament material with the warp filaments of the warp unidirectional filament material extending in the circumferential direction of the end cap, and a plurality of lengths of resin-impregnated filaments extending generally radially across the end cap.

2. The combination of claim 1, wherein the at least one end cap comprises a generally cup-shaped end cap.

3. The combination of claim 2, wherein the generally cup-shaped end cap comprises a curved section and a generally cylindrical section adapted to be attached to an end of the cylindrical portion of the container.

4. The combination of claim 3, wherein the core and the exterior encapsulating layer of the end of the cylindrical portion and the core and the exterior encapsulating layer of the generally cylindrical section of the end cap are each cut back to form a transition attachment region, and one of the interior encapsulating layers of the cylindrical portion and the cylindrical section of the end cap overlaps the other in the transition region.

5. The combination of claim 4, further comprising a cylindrical transition core section disposed in the transition attachment region over the one overlapping interior encapsulating layer, and an exterior transition encapsulating layer disposed in the transition attachment region and disposed over the cylindrical transition core section, the one overlapping interior encapsulating layer in the transition attachment region, the cylindrical transition core section and the exterior transition encapsulating layer comprising a bonded sandwich construction in the transition attachment region.

6. A method of fabricating an end cap for the cylindrical portion of a composite laminated, generally cylindrical container for over-the-road transportation of liquids by truck, the container comprising a cylindrical portion and a pair of end caps, the cylindrical portion being of sandwich construction and having an inner core layer and an encapsulating layer adhered to each of the interior and exterior surfaces of the inner core layer, and wherein the inner core layer and the interior and exterior encapsulating layers are co-adhered to each other to form a bonded sandwich construction for the cylindrical portion, the method of fabricating the end cap comprising:

providing a generally cup-shaped form;

fabricating an interior encapsulating layer for the end cap, said fabricating of the interior encapsulating layer comprising:

applying at least one layer of resin-impregnated warp unidirectional filament material over the form with the warp filaments of the warp unidirectional filament material extending in the circumferential direction of the form, and applying a plurality of lengths of resin-impregnated filaments generally radially across the form;

thermoforming an expanded plastic foam sheet to conform to the shape of the cup-shaped form and placing the thermoformed sheet over the interior encapsulating layer to form a core layer for the end cap;

pressing the expanded plastic foam sheet into the interior encapsulating layer to cause the sheet to absorb the resin of the interior encapsulating layer; and fabricating an exterior encapsulating layer for the end cap, said fabricating of the exterior encapsulating layer comprising:

applying at least one layer of resin-impregnated warp unidirectional filament material over the core layer with the warp filaments of the warp unidirectional filament material extending in the circumferential direction of the form, and applying a plurality of lengths of resin-impregnated filaments generally radially across the form.

7. The method of claim 6, wherein the fabricating of each of the interior and exterior encapsulating layers of the end cap further comprises applying at least one layer of a mixture of liquid vinyl ester resin and chopped vinyl ester filaments over the form and the core layer, respectively.

8. The method of claim 6, further comprising applying an exterior plastic coating comprising a polyester gel coat over the exterior encapsulating layer of the end cap.

9. The method of claim 6, wherein the cup-shaped form comprises a curved section and a generally cylindrical section adapted to be attached to an end of the cylindrical portion of the container, the method further comprising:

cutting back the core layer and the exterior encapsulating layer of an end of the cylindrical portion of the container and the generally cylindrical section of the end cap to form a transition attachment region;

overlapping one of the interior encapsulating layers of the end of the cylindrical portion of the container and the cylindrical section of the end cap over the other in the transition attachment region;

placing a pair of semi-cylindrical expanded plastic foam sheets over the one overlapped interior encapsulating layer to form a cylindrical transition core section in the transition attachment region;

pressing the semi-cylindrical expanded plastic foam sheets into the overlapped interior encapsulating layer to cause the sheets to absorb the vinyl ester resin of the overlapped interior encapsulating layer; and fabricating an exterior encapsulating layer for the transition attachment region.

10. A method of making a composite laminated container for over-the-road transportation of liquids by truck, the container comprising a cylindrical portion and a pair of end caps for the cylindrical portion, the cylindrical portion and the pair of end caps being of sandwich construction, each of the cylindrical portion and the end caps comprising an inner core layer and a pair of encapsulating layers, the inner core layer and the encapsulating layers of each of the cylindrical portion and the pair of end caps being co-adhered one to the other, comprising:

A. fabricating a central longitudinally extending, cylindrical portion for the container, said fabricating comprising:

(1) providing a collapsible rotatable cylindrical mandrel;

(2) fabricating an inner encapsulating layer for the cylindrical portion, said fabricating of the inner encapsulating portion comprising:

(a) spiral wrapping the mandrel with at least one layer of a releasing material to facilitate the ultimate release of the cylindrical portion from the mandrel, (b) spraying a layer of liquid vinyl ester resin over the releasing material, (c) winding at least one layer of surfacing veil over the layer of liquid vinyl ester resin, (d) applying a layer of a mixture of liquid vinyl ester resin and chopped vinyl ester filaments over the layer of surfacing veil, (e) spraying a layer of liquid vinyl ester resin over the layer of mixed vinyl ester resin and chopped vinyl ester filaments, (f) applying at least one layer of vinyl ester resin-impregnated, weft unidirectional material over the layer of liquid vinyl ester resin with the weft filaments of the weft unidirectional material extending in the longitudinal direction of the cylindrical portion, (g) immersing a plurality of vinyl ester filaments in liquid vinyl ester resin material and forming the plurality of filaments into a band, (h) spiral winding a plurality of lengths of the filament band over the layer of vinyl ester resin-impregnated, weft unidirectional material, back and forth, at a plurality of winding angles of about 80 degrees to form a layer of spirally wound filament bands, and (i) applying a layer of a mixture of liquid vinyl ester resin and chopped vinyl ester filaments over the layer of spirally wound filament bands to complete the inner encapsulating layer of the cylindrical portion;

(3) thermoforming a plurality of cellular thermoplastic expanded plastic foam sheets to form a plurality of pairs of semi-cylindrical sections, the sections having a radius generally equal to the radius of the mandrel, and placing the semi-cylindrical sections over the inner encapsulating layer to provide an inner core layer for the cylindrical portion;

(4) pressing the semi-cylindrical sections into the inner encapsulating layer to cause the expanded plastic foam sheets to absorb the vinyl ester resin of the inner encapsulating layer;

(5) fabricating an outer encapsulating layer for the cylindrical portion, said fabricating of the outer encapsulating layer comprising:

(a) applying a layer of a mixture of liquid vinyl ester resin and chopped vinyl ester filaments over the semi-cylindrical sections of the core layer, (b) spraying a layer of liquid vinyl ester resin over the layer of liquid vinyl ester resin and chopped vinyl ester filaments, (c) applying at least one layer of vinyl ester resin-impregnated, weft unidirectional filament material over the layer of liquid vinyl ester resin with the weft filaments of the weft unidirectional filament material extending in the longitudinal direction of the cylindrical portion, and (d) spiral winding a plurality of lengths of the filament band over the layer of vinyl ester resin-impregnated, weft unidirectional filament material, back and forth, at a plurality of winding angles of about 80 degrees to form a layer of spirally wound filament bands and complete the outer encapsulating layer;

(6) applying an exterior plastic coating comprising a polyester gel coat over the outer encapsulating layer of the cylindrical portion to complete the cylindrical portion of the container;

B. fabricating at least one generally cup-shaped end cap for the container, said fabricating of the end cap comprising:

(1) providing a generally cup-shaped form, the cup-shaped form comprising a curved section and a generally cylindrical section adapted to be attached to an end of the cylindrical portion of the container;

(2) applying a layer of wax to the exterior surface of the cup-shaped form to facilitate the ultimate release of the end cap from the cup-shaped form;

(3) fabricating an inner encapsulating layer for the end cap, said fabricating of the inner encapsulating layer comprising:

(a) spraying a layer of liquid vinyl ester resin over the layer of wax, (b) winding at least one layer of surfacing veil over the layer of liquid vinyl ester resin (c) applying a layer of a mixture of liquid vinyl ester resin and chopped vinyl ester filaments over the layer of surfacing veil, (d) spraying a layer of liquid vinyl ester resin over the layer of the mixture of liquid vinyl ester resin and chopped vinyl ester filaments, (e) winding at least one layer of vinyl ester resin-impregnated, warp unidirectional filament material around the generally cylindrical section of the cup-shaped form with the warp filaments of the warp unidirectional filament material extending in the circumferential direction of the form, (f) immersing a plurality of vinyl ester filaments in liquid vinyl ester resin material and forming the plurality of filaments into a band, (g) applying a plurality of lengths of the filament band generally radially across the exterior surface of the cup-shaped form, each of the lengths being indexed a selected number of degrees in the circumferential direction, to complete the inner encapsulating layer;

(4) thermoforming an expanded plastic foam sheet to a shape compatible to the exterior surface of the cup-shaped form and placing the thermoformed sheet over the inner encapsulating layer to form the inner core layer of the end cap of the container;

(5) pressing the thermoformed expanded plastic foam sheet into the inner encapsulating layer to cause the expanded plastic foam sheet to absorb the vinyl ester resin of the inner encapsulating layer;

(6) fabricating an outer encapsulating layer for the end cap, said fabricating of the outer encapsulating layer comprising:

(a) spraying a layer of liquid vinyl ester resin over the inner core layer, (b) winding at least one layer of vinyl ester resin-impregnated, warp unidirectional filament material around the generally cylindrical section of the cup-shaped form with the warp filaments of the warp unidirectional filament material extending in the circumferential direction of the form, (c) applying a plurality of lengths of the filament band generally radially across the exterior surface of the cup-shaped form, each of the lengths being indexed a selected number of degrees in the circumferential direction, (d) applying a mixture of liquid vinyl ester resin and chopped vinyl ester filaments over the radially indexed lengths of filament band, and (e) winding a layer of surfacing veil over the layer of liquid vinyl ester resin and chopped vinyl ester filaments to complete the outer encapsulating layer of the end cap;

(7) applying an exterior plastic coating comprising a polyester gel coat over the outer encapsulating layer of the end cap to complete the end cap;

C. collapsing the cylindrical mandrel and sliding the longitudinally extending cylindrical section over the layer of releasing material to remove the cylindrical section from the cylindrical mandrel;

D. removing the end cap from the cup-shaped form; and

E. attaching the end cap to the one end of the cylindrical section.

* * * * *